US007467932B2

(12) United States Patent
Schann et al.

(10) Patent No.: US 7,467,932 B2
(45) Date of Patent: Dec. 23, 2008

(54) PERISTALTIC PUMP COMPRISING MEMBERS FOR LOCATING A TUBE

(75) Inventors: Christian Schann, Oberhausebergen (FR); Stephane Olivier, Rosheim (FR); Christian Clauss, Obernai (FR)

(73) Assignee: Millipore Corporation, Billerica, MA (US)

( * ) Notice: Subject to any disclaimer, the term of this patent is extended or adjusted under 35 U.S.C. 154(b) by 384 days.

(21) Appl. No.: 11/152,517

(22) Filed: Jun. 14, 2005

(65) Prior Publication Data

US 2006/0002805 A1 Jan. 5, 2006

(30) Foreign Application Priority Data

Jun. 30, 2004 (FR) ..... 04 07260

(51) Int. Cl.
*F04B 43/08* (2006.01)
*F04B 43/12* (2006.01)
*F04B 45/06* (2006.01)

(52) U.S. Cl. ..... 417/477.1

(58) Field of Classification Search ..... 417/477.9, 417/477.8, 477.3, 474, 475, 476, 477.1, 477.11, 417/477.13, 477.2, 477.6
See application file for complete search history.

(56) References Cited

U.S. PATENT DOCUMENTS 3,502,034 A * 3/1970 Pickup ..... 417/475
3,658,445 A * 4/1972 Pulman et al. ..... 417/474
3,737,251 A * 6/1973 Berman et al. ..... 417/12
3,841,799 A * 10/1974 Spinosa et al. ..... 417/477.2
3,887,436 A * 6/1975 Haddad et al. ..... 435/293.2
3,918,854 A * 11/1975 Catarious et al. ..... 417/477.11
3,963,023 A * 6/1976 Hankinson ..... 604/19
4,201,525 A * 5/1980 Brown et al. ..... 417/477.5
4,263,909 A * 4/1981 Bush ..... 604/153
4,363,609 A * 12/1982 Cosentino et al. ..... 417/477.5
4,482,347 A * 11/1984 Borsanyi ..... 604/153
4,540,351 A * 9/1985 Olson ..... 417/476
4,558,996 A * 12/1985 Becker ..... 417/374
4,725,205 A * 2/1988 Cannon et al. ..... 417/363
4,954,046 A * 9/1990 Irvin et al. ..... 417/53
5,116,203 A * 5/1992 Natwick et al. ..... 417/53
5,211,548 A * 5/1993 Okada ..... 417/474
5,290,158 A * 3/1994 Okada ..... 417/474
5,349,825 A * 9/1994 Duke et al. ..... 62/69
5,388,972 A * 2/1995 Calhoun et al. ..... 417/477.11
5,415,532 A * 5/1995 Loughnane et al. ..... 417/411
5,482,438 A * 1/1996 Anderson et al. ..... 417/44.1
5,514,102 A * 5/1996 Winterer et al. ..... 604/67
5,772,409 A * 6/1998 Johnson ..... 417/360
5,788,671 A * 8/1998 Johnson ..... 604/131
5,823,746 A * 10/1998 Johnson ..... 417/53

(Continued)

FOREIGN PATENT DOCUMENTS

AU 1153895 B * 3/1995

(Continued)

*Primary Examiner*—Devon C Kramer
*Assistant Examiner*—Alexander B Comley

(57) ABSTRACT

The peristaltic pump (1) comprises a rotor with rollers, a mobile jaw having an open position and a closed position, and further comprises, on each side of the rotor, a locating member for said tube adapted to receive it when it is pressed in and to allow it to slide in the longitudinal direction in which the locating member extends, said locating members being disposed in a line between the rotor and the mobile jaw in the open position.

9 Claims, 9 Drawing Sheets

U.S. PATENT DOCUMENTS

| | | | | |
|---|---|---|---|---|
| 5,888,052 | A * | 3/1999 | Hill | 417/53 |
| 5,964,583 | A * | 10/1999 | Danby | 417/474 |
| 6,139,531 | A * | 10/2000 | Danby | 604/153 |
| 6,164,921 | A * | 12/2000 | Moubayed et al. | 417/44.1 |
| 6,595,950 | B1 * | 7/2003 | Miles et al. | 604/80 |
| 6,623,447 | B2 * | 9/2003 | Miles et al. | 604/80 |
| 6,685,670 | B2 * | 2/2004 | Miles et al. | 604/80 |
| 6,942,473 | B2 * | 9/2005 | Abrahamson et al. | 417/474 |
| 7,223,079 | B2 * | 5/2007 | Ortega et al. | 417/53 |
| 7,241,119 | B2 * | 7/2007 | Harada | 417/477.11 |
| 2004/0179964 | A1 * | 9/2004 | O'Mahony et al. | 417/477.2 |
| 2005/0025647 | A1 * | 2/2005 | Ortega et al. | 417/477.1 |
| 2005/0196307 | A1 * | 9/2005 | Limoges | 417/476 |
| 2005/0214146 | A1 * | 9/2005 | Corwin et al. | 417/477.9 |
| 2005/0238515 | A1 * | 10/2005 | Kent | 417/476 |
| 2005/0238516 | A1 * | 10/2005 | Kent | 417/477.8 |
| 2006/0002799 | A1 * | 1/2006 | Schann et al. | 417/1 |

FOREIGN PATENT DOCUMENTS

| | | | |
|---|---|---|---|
| DE | 3943430 | A1 * | 4/1991 |
| GB | 2069063 | A * | 8/1981 |
| JP | 01092594 | A * | 4/1989 |

* cited by examiner

PERISTALTIC PUMP COMPRISING MEMBERS FOR LOCATING A TUBE

CROSS REFERENCE RELATED APPLICATIONS

This application claims priority to French Application No.: 0407260, filed on Jun. 30, 2004.

The invention relates to the general field of peristaltic pumps.

It relates more particularly to a peristaltic pump comprising means for locating a tube intended to function with the pump.

A peristaltic pump, as used in the medical field in particular, is a pump whose rotor is provided incorporating rollers that progressively compress the cross section of an elastic tube to move a liquid along the tube.

This kind of pump is therefore used to circulate a fluid inside a tube by operating only on the tube, without coming into contact with the liquid. This type of pump is therefore suitable for any application requiring the fluid to remain in a confined atmosphere, for example to avoid contamination of the fluid when working in a sterile environment. A peristaltic pump is generally adapted to operate in an environment where the concept of sterility is of primordial importance. The pump must therefore not only fulfill its function of circulating a fluid and preventing its contamination by the environment, but also avoid contamination of the environment by the pump itself. The various components of the pump must therefore be easy to clean, where appropriate by being demountable, at the same time as ensuring a perfect seal.

A peristaltic pump typically comprises a rotor comprising rollers at its periphery and a mobile jaw adapted to assume an open position, in which it is moved away from the rotor so that an elastically deformable tube on which the pump has to act may be placed between the jaw and the rotor, and a closed position, in which the mobile jaw is moved toward the rotor so that the tube is gripped between a curved bearing surface on the mobile jaw and at least one roller of the rotor.

Placing a tube in the peristaltic pumps available at present is a difficult operation. This is because the tube must be located correctly around the rotor, without undesirable pinching of the tube by the mobile jaw.

When fitting a tube to these prior art pumps, the mobile jaw is first moved away from the rotor, after which the tube is placed manually around the rotor, and its retention must then be assured or monitored while the mobile jaw moves to lock the tube in the position against the rotor in which it is located. The mobile jaw is generally moved by a cam that is operated manually. This movement may equally well be imparted directly to the mobile jaw by the hands of the user, after which it is locked in its position close to the rotor by a toggle device.

The object of the invention is to improve the above type of pump.

To this end, the invention provides a peristaltic pump comprising a rotor incorporating rollers, a mobile jaw having an open position, in which it is moved away from the rotor so that a tube on which said pump must act may be placed between the jaw and the rotor, and a closed position, in which the mobile jaw is moved toward the rotor so that said tube is engaged between a curved bearing surface of the mobile jaw and at least one roller of the rotor, this pump being characterized in that it further comprises, on each side of the rotor, a locating member for said tube adapted to receive it when it is pressed in and to allow it to slide in the longitudinal direction in which the tube extends, said locating members being disposed in a line between the rotor and the mobile jaw in the open position.

Thanks to this, when a tube is in place in the locating members and the mobile jaw is moved toward its closed position, the tube takes up a position around the rotor as the mobile jaw is closed.

The above kind of pump enables a tube to be fitted and removed easily, quickly and repeatably. The tube may be fitted straight, stretched between the two hands of the user, without it being necessary to wrap the tube around the rotor. The tube may therefore be fitted blind, as is generally the case when working in a sterile environment.

The operation of closing the mobile jaw is also dissociated from the operation of fitting the tube to the pump, and the closure of the mobile jaw may therefore be motor driven.

When the tube has been placed in the locating members, and before the mobile jaw is closed, the tube is able to slide laterally so that the user can adjust the length of tube available on either side of the pump head.

The jaw may be closed without effort and without particular care on the part of the user because the final positioning of the tube against the rotor is brought about by the pump and not by the operator.

From the user safety point of view, the above kind of pump reduces the operation of fitting the tube to merely fitting it to the locating members. No direct or indirect cooperation with the mobile components of the pump (such as the rotor or the mobile jaw) is necessary, thus preventing all risk of the fingers or the gloves of the user being pinched, the user having his hands free as soon as the tube has been engaged in the locating members.

In one embodiment, the locating members are fastened to the mobile jaw.

The locating members may equally be part of a protective cap adapted to cover the mobile jaw and the rotor incorporating rollers, including in the open position.

The protective cap may be rigidly connected to the mobile jaw.

According to a preferred feature, the protective cap comprises a rectilinear groove joining the locating members.

According to another preferred feature, the rotor comprises a flat and the pump further comprises means for positioning the flat along said line.

This flat delimits a rectilinear passage between the two locating members.

Each locating member may comprise a depression delimited by a bottom and two facing lateral walls each comprising a retaining boss.

According to a preferred feature, the peristaltic pump comprises a motor adapted to drive the mobile jaw from its open position to its closed position.

This closure device avoids stressing the parts, unlike toggle devices.

Said motor may be connected by irreversible gears to a cam cooperating with the mobile jaw.

The motor may additionally be adapted to place the mobile jaw in a position in which it is free to be separated from the pump.

One embodiment of the peristaltic pump comprises means for gripping the web of a multiple passage tube with the passages connected by a web.

Other features and advantages of the invention will become apparent in the light of the following description of a preferred embodiment of the invention, which is given by way of nonlimiting example and with reference to the appended drawings, in which:

FIG. 1 shows a peristaltic pump 1 in one of the applications of this type of pump.

Figure 1:
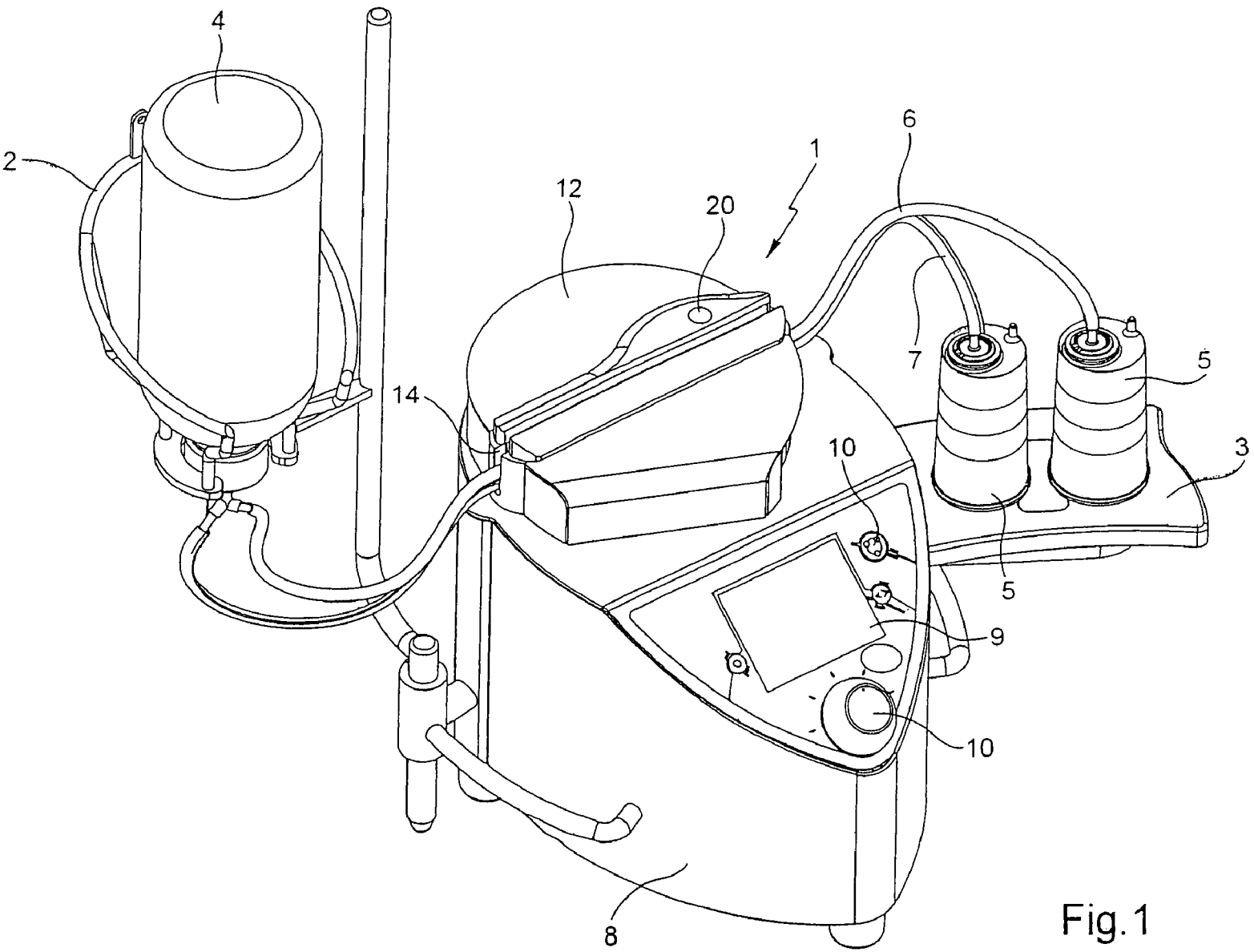
FIG. 1 is a perspective view of a peristaltic pump and its accessories ready for operation.

In the present example, the pump 1 comprises accessories such as a bottle rack 2 and a flow drawer 3. This configuration is used to pump the liquid contained in a bottle 4 toward two containers 5 through a tube connected at one end to the bottle 4 and at the other end to the containers 5.

In this example the tube 6 comprises two separate passages sealed with respect to each other and connected to each other by a longitudinal web 7 that is easy to cut.

The peristaltic pump 1 comprises a pump body 8 on which are disposed a display 9 and control keys 10.

The pump 1 also comprises a pump head 11 (shown in FIG. 3) which is covered by a protective cap 12 in FIG. 1.

Figure 2:
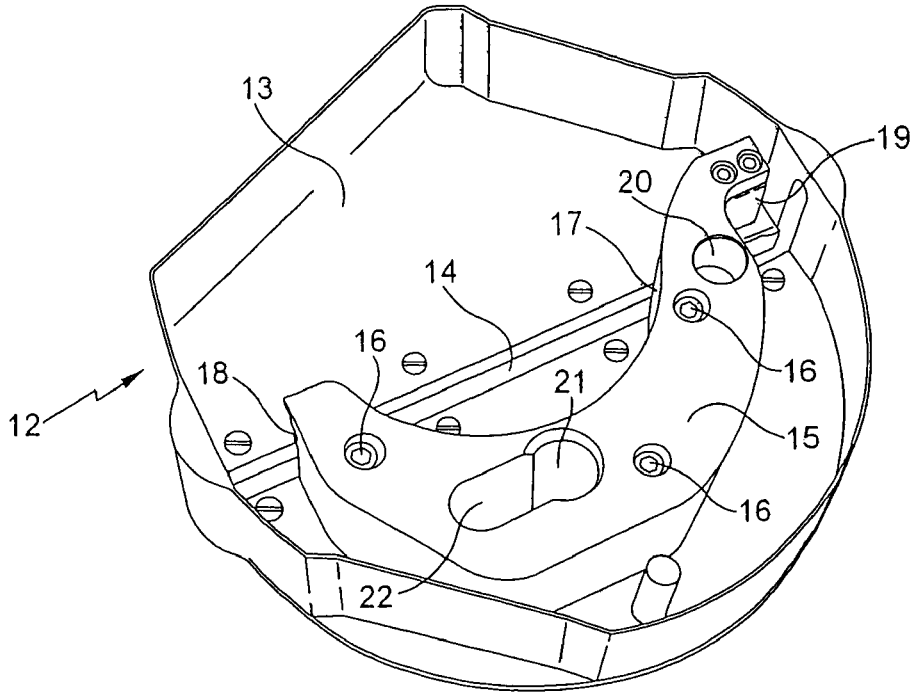
FIG. 2 is a bottom perspective view of a protective cap placed on the top of the pump shown in FIG. 1.

FIG. 2 is a bottom perspective view of the protective cap 12 when it has been removed from the pump 1. The protective cap 12 comprises an envelope 13 in the form of a cover adapted to cover the mobile elements of the pump head 11 to prevent the user coming into contact with them. The envelope 13 comprises a straight groove 14 of sufficient width for the tube 6 to slide therein.

A mobile jaw 15 is fixed to the inside wall of the envelope 13 by three screws 16. The general shape of the mobile jaw 15 is that of a crescent moon, the inside wall of its curved portion comprising a curved bearing surface 17 of circular arc shape. On respective opposite sides of this bearing surface 17 the mobile jaw 15 comprises a tooth 18 and a bearing member 19, both adapted to cooperate with the tube 6, like the bearing surface 17.

The mobile jaw 15 further comprises a hole 20 through the wall of the envelope 13 (see FIG. 1).

Figure 13:
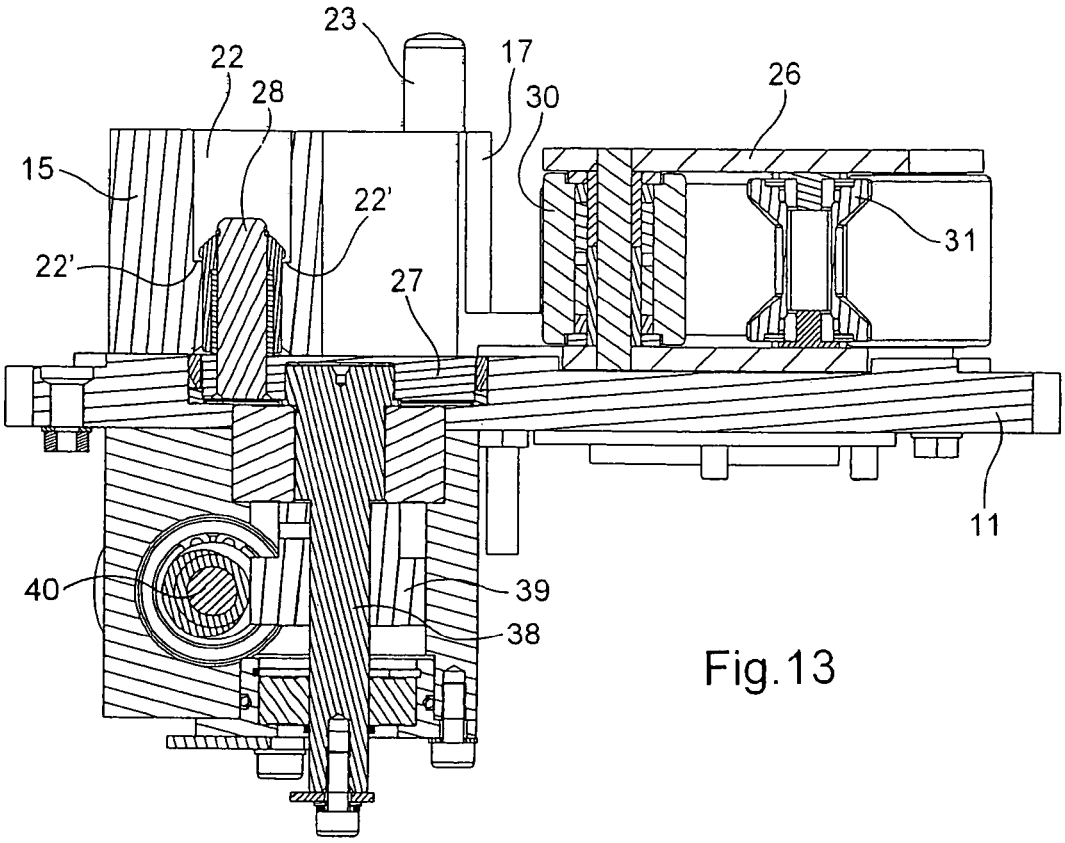
FIG. 13 is a side view of the assembly shown in FIG. 12 in section on a plane passing through the rotor incorporating rollers and a cam actuating the mobile jaw.

A round hole 21 communicating with an oblong hole 22 is also formed in the thickness of the mobile jaw 15. In FIG. 13, which shows the profile of the oblong hole 22, it is apparent that the latter comprises a shoulder 22' substantially halfway through the thickness of the mobile jaw 15. The round hole 21 does not include this shoulder.

Figure 3:
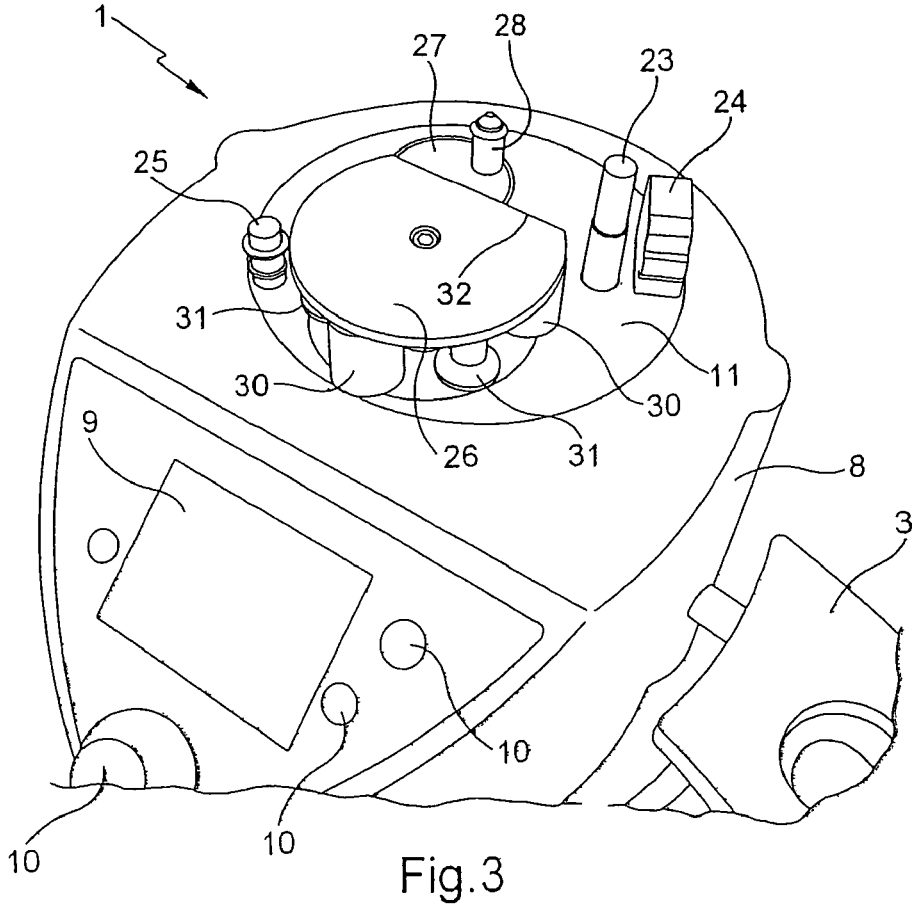
FIG. 3 is a plan view of the pump shown in FIG. 1 when the protective cap shown in FIG. 2 has been removed.

FIG. 3 shows the pump head 11 when the protective cap 12 has been removed. The pump head 11 takes the form of a plate on which are fixedly mounted a counter-member 24, a stop pin 25, and a shaft 23 adapted to be inserted into the hole 20 in the mobile jaw 15 to enable the jaw to rotate.

The pump head 11 also receives a rotatably mounted rotor 26 incorporating rollers and a plate 27 from which projects an eccentric finger 28.

Figure 4:
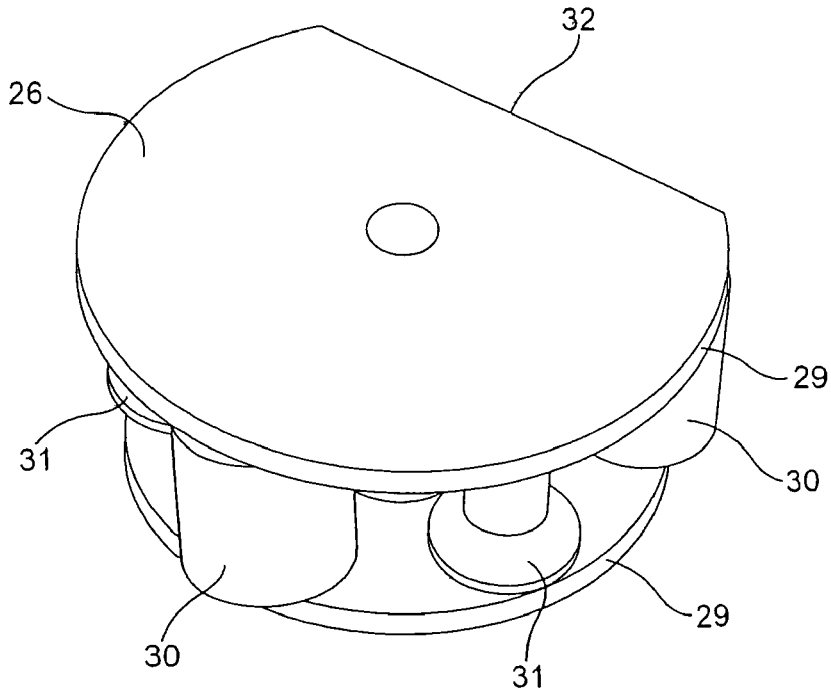
FIG. 4 shows a rotor incorporating rollers that is visible on top of the pump in FIG. 3.

FIG. 4 represents the rotor 26 incorporating the rollers 30 and 31 when removed from the pump 1. The rotor 26 comprises two flanges 29 between which are rotatably mounted three cylindrical rollers 30 and two centering rollers 31, the cylindrical rollers 30 being regularly spaced at 120° to each other around the contour of the flanges 29.

The flange 29 that is the upper flange in FIG. 4 comprises a flat 32.

Figure 14:
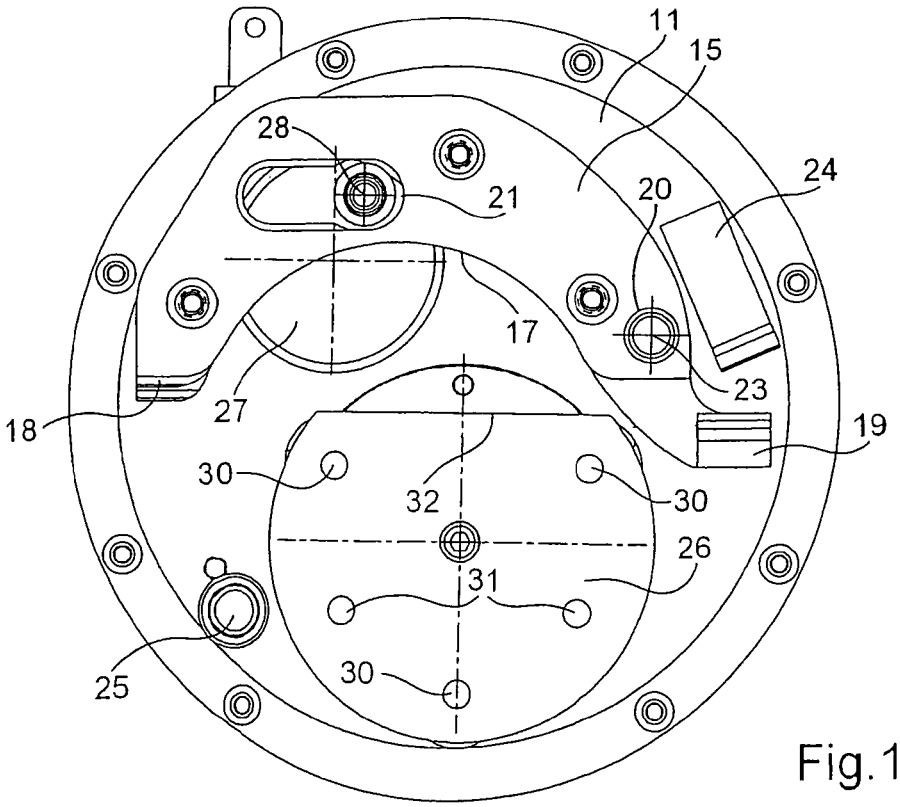
FIGS. 14 to 16 are plan views of the pump head shown in FIG. 12, showing the mobile jaw in different positions.

The disposition of the cylindrical rollers 30, the centering rollers 31 and the flat 32 may be seen in FIG. 14.

Figure 5:
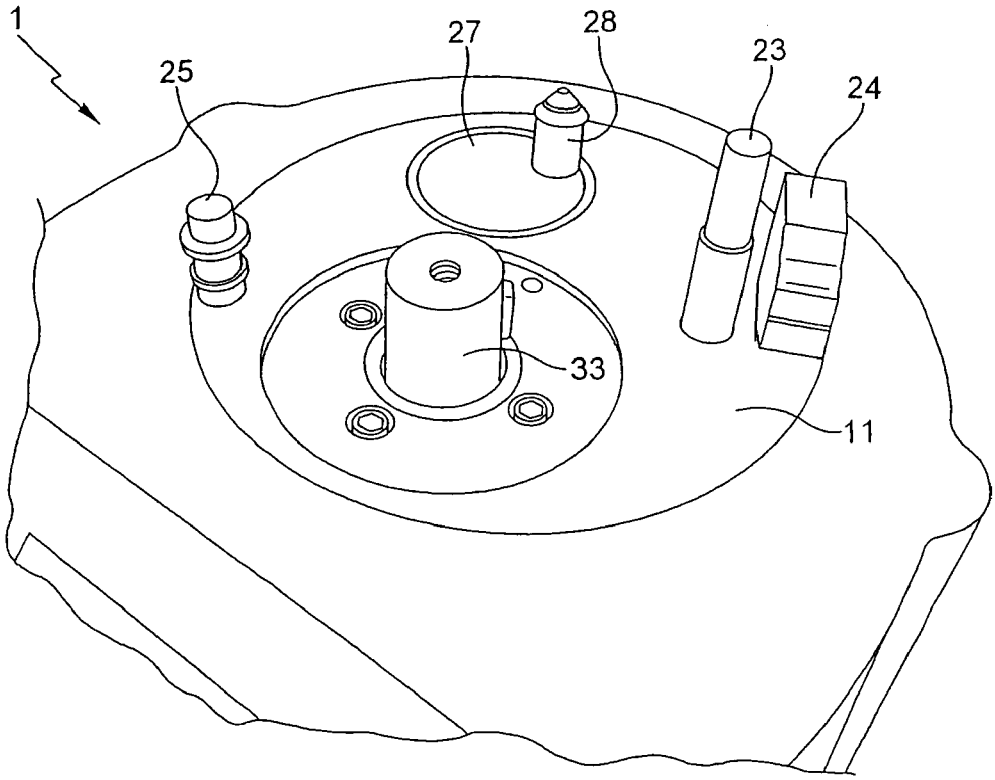
FIG. 5 is a view similar to FIG. 3 when the rotor shown in FIG. 4 has been removed.

FIG. 5 shows the pump head shown in FIG. 3 when the rotor 26 has been removed. This figure shows a drive shaft 33 which drives rotation of the rotor 26 to fulfill the main function of the pump 1.

Figure 6:
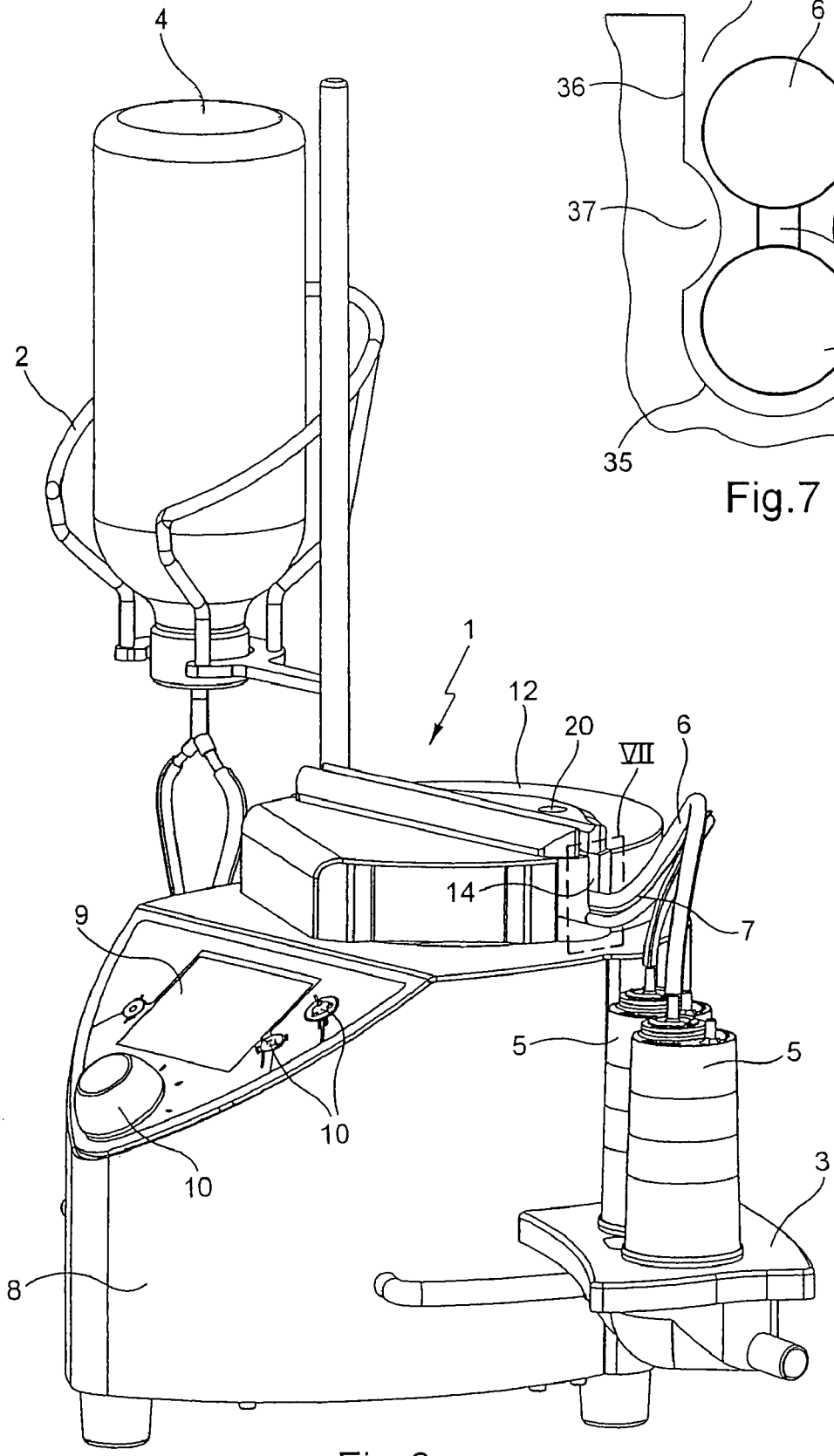
FIG. 6 is a different perspective view of the pump shown in FIG. 1.

FIG. 6 is a perspective side view of the pump 1, a framed portion VII of this figure showing the cooperation of the tube 6 and the cap 12.

Figure 7:
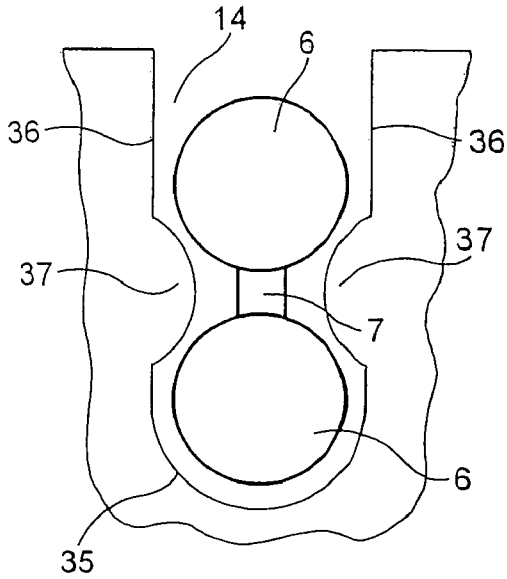
FIG. 7 is a view to a larger scale of the framed portion VII of FIG. 6.

FIG. 7, which is a view to a larger scale of the framed portion VII of FIG. 6, shows the portion of the groove 14 in which the tube 6 is engaged. This portion of the groove 14 is delimited by a bottom 35 in the shape of a circular arc and two facing lateral walls 36. Each of these lateral walls 36 comprises a retaining boss 37, the two bosses 37 being disposed face-to-face.

The portion of the groove 14 visible in FIG. 7 forms a positioning member adapted to receive the tube 6 when the latter is pressed into it and to enable sliding of the tube relative to the longitudinal axis along which it extends, in other words parallel to itself.

Note that when the tube 6 is pressed into this portion of the groove 14 (see FIG. 9) to obtain the assembly shown in FIG. 7, the tube 6 first slides down the lateral walls 36, until its lower passage comes into contact with the bosses 37, which creates a hard point to be overcome in order to press the tube 6 all the way in. The user then continues to press in the tube 6, which elastically deforms the lower passage of the tube, which then takes up a position facing the bottom 35. The web 7 of the tube 6 takes up a position between the two bosses 37, which retains the tube 6 in the direction of the portion of the groove 14 shown in FIG. 7.

Figure 10:
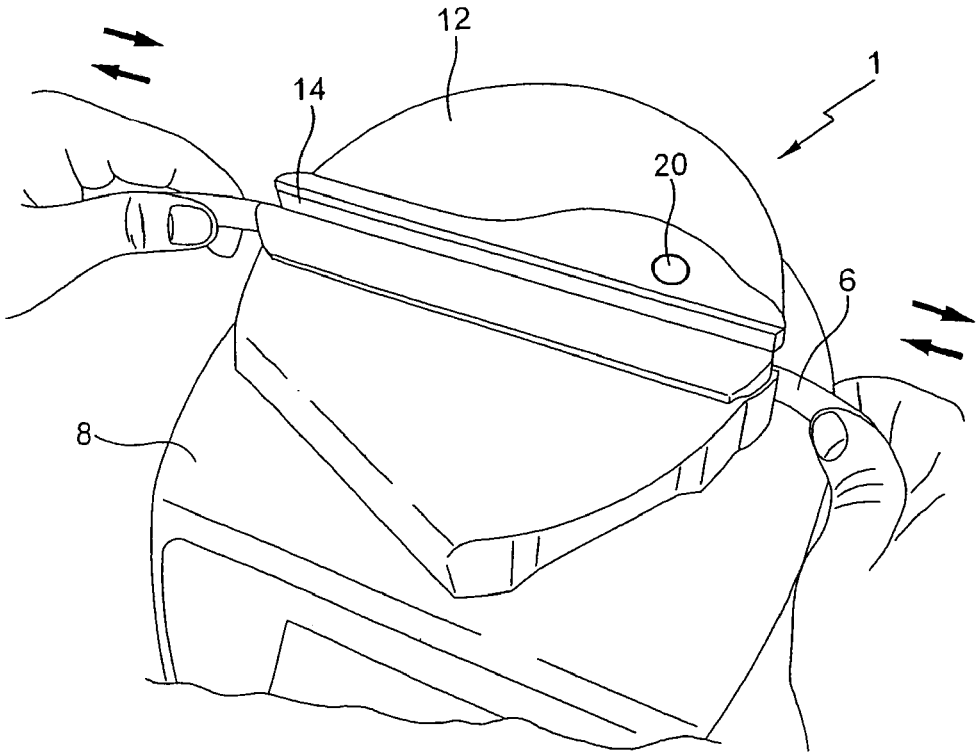
FIG. 10 is a diagrammatic view similar to FIG. 9 showing lateral adjustment of the tube shown in FIG. 9.

Although the lower passage of the tube 6 is retained in its housing by the bosses 37, a clearance remains between the tube 6 and the positioning member, which allows the sliding previously referred to (see FIG. 10).

The tube 6 is also removed by elastically deforming the lower passage of the tube 6, which likewise overcomes the hard point.

Figure 8:
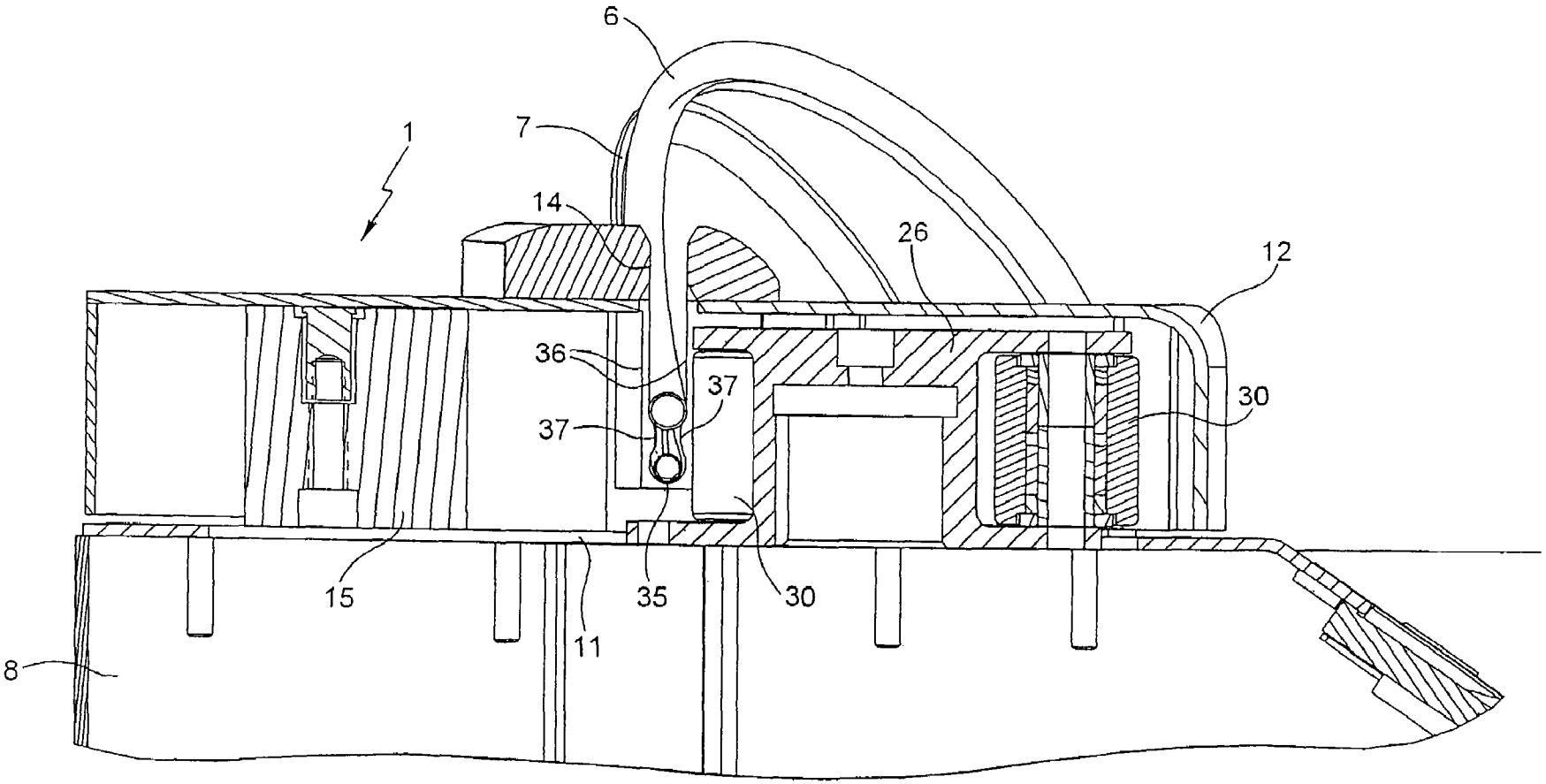
FIG. 8 is a view in longitudinal section of the top of the pump shown in FIGS. 1 and 6, showing the placing of the tube into the protective cap.

FIG. 8 shows in section the position of the tube 6 as just described.

Figure 11:
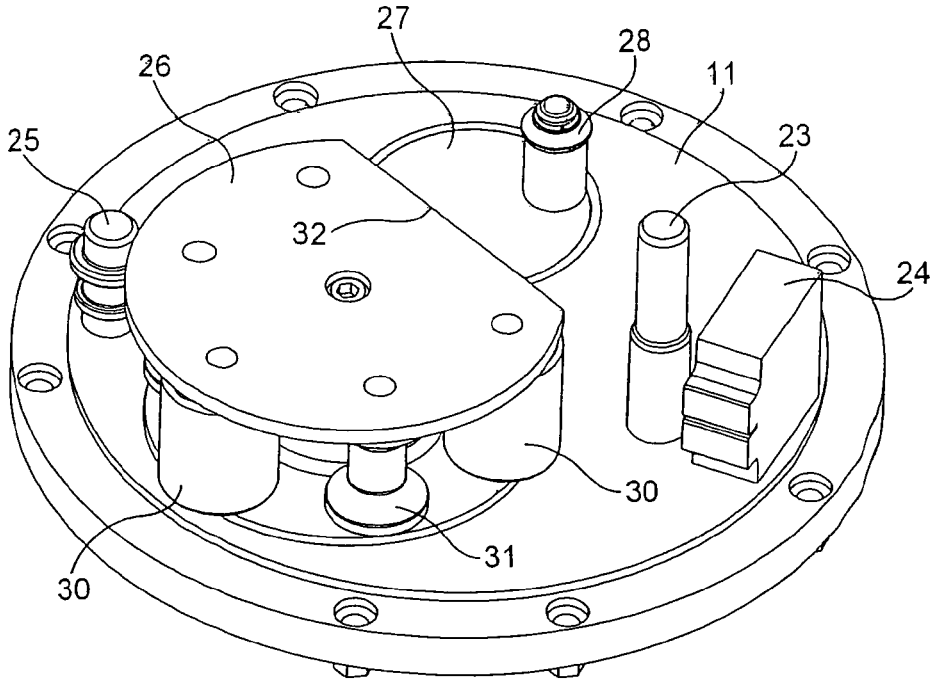
FIG. 11 is a perspective view of the head of the pump shown in FIG. 3.

FIG. 11 is a perspective view of the pump head 11 in the FIG. 3 configuration.

Figure 12:
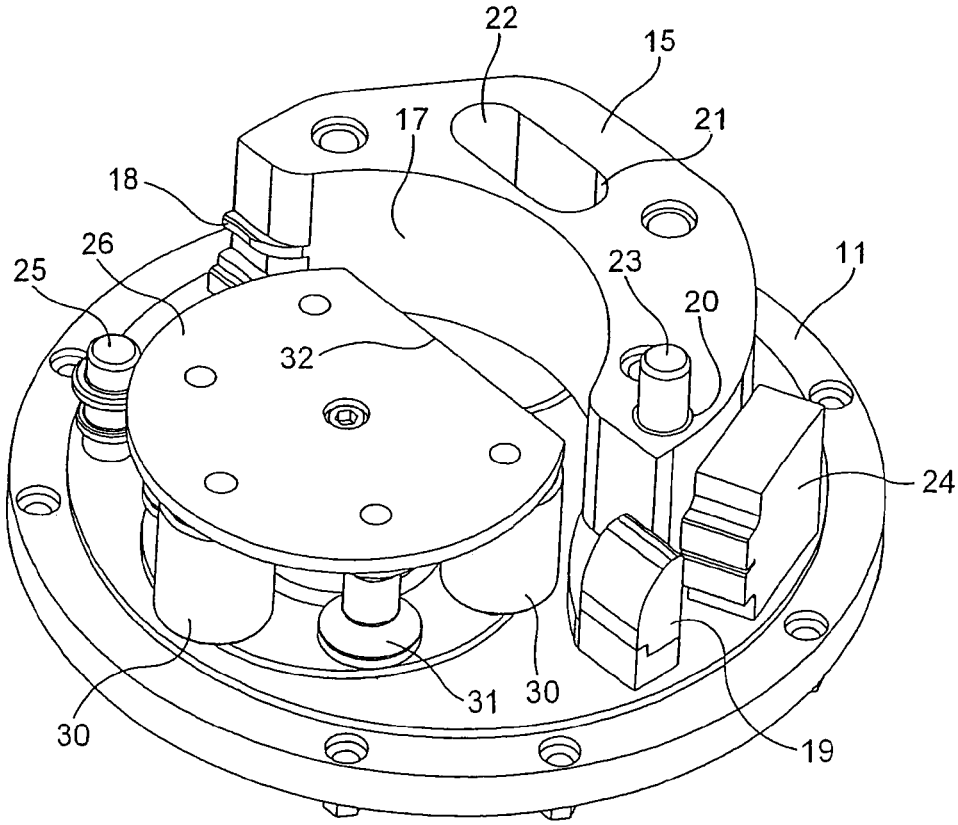
FIG. 12 is a perspective view similar to FIG. 11 also showing the mobile jaw shown in FIG. 2.

FIG. 12 shows the pump head 11 when the mobile jaw 15 has been fitted; this figure shows the jaw separated from the cover 12, in order to show the cooperation of the mobile jaw 15 with the components mounted on the pump head 11.

FIG. 13 is a view in section of the assembly shown in FIG. 12 and shows in particular the mounting of the plate 27 on the pump head 11.

The plate 27 is fastened to a drive shaft 38 that is mounted on bearings and rotates relative to the pump head 11. The shaft 38 is fastened to a gear 39 meshing with a worm gear 40 that is driven in rotation by a motor (not shown).

Figure 15:
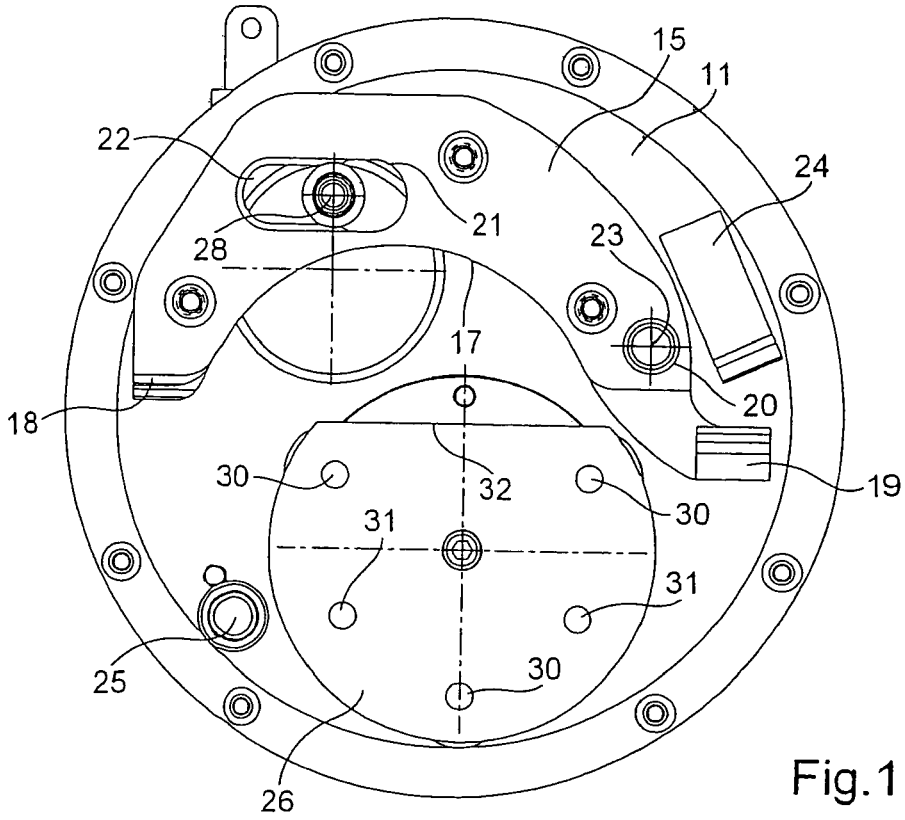
Figure 16:
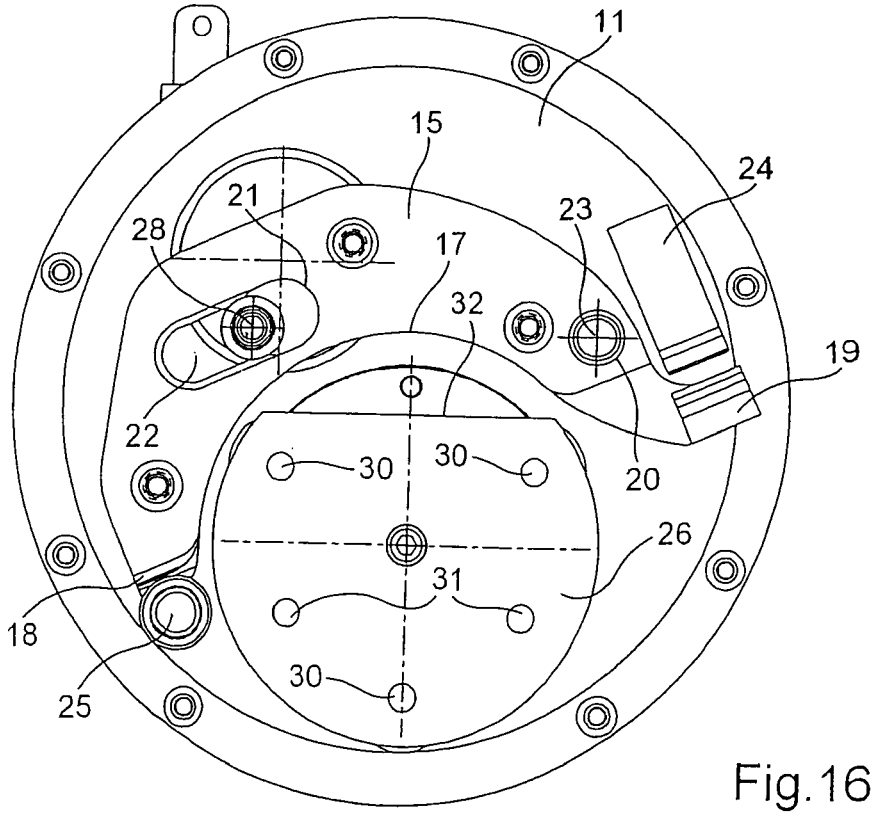

FIGS. 14 to 16 are plan views of the assembly shown in FIG. 12 in three particular positions of the mobile jaw 15 defined by the eccentric finger 28, that is to say by the angular position of the plate 27.

FIG. 14 shows the eccentric finger 28 in a position allowing the mobile jaw 15 to be fitted to the pump head 11.

In FIG. 15, the mobile jaw 15 is in the same position as in FIG. 14 but the eccentric finger 28 is in a position in which it locks the mobile jaw 15 and prevents it from being extracted from the pump head 11.

FIG. 16 represents the mobile jaw when closed by the eccentric finger 28.

The successive positions represented in FIGS. 14 to 16 are not visible from the outside in normal use of the pump 1, this region being covered by the cap 12 that is normally fitted over the jaw 15.

The peristaltic pump 1 that has just been described operates in the manner indicated hereinafter.

Figure 9:
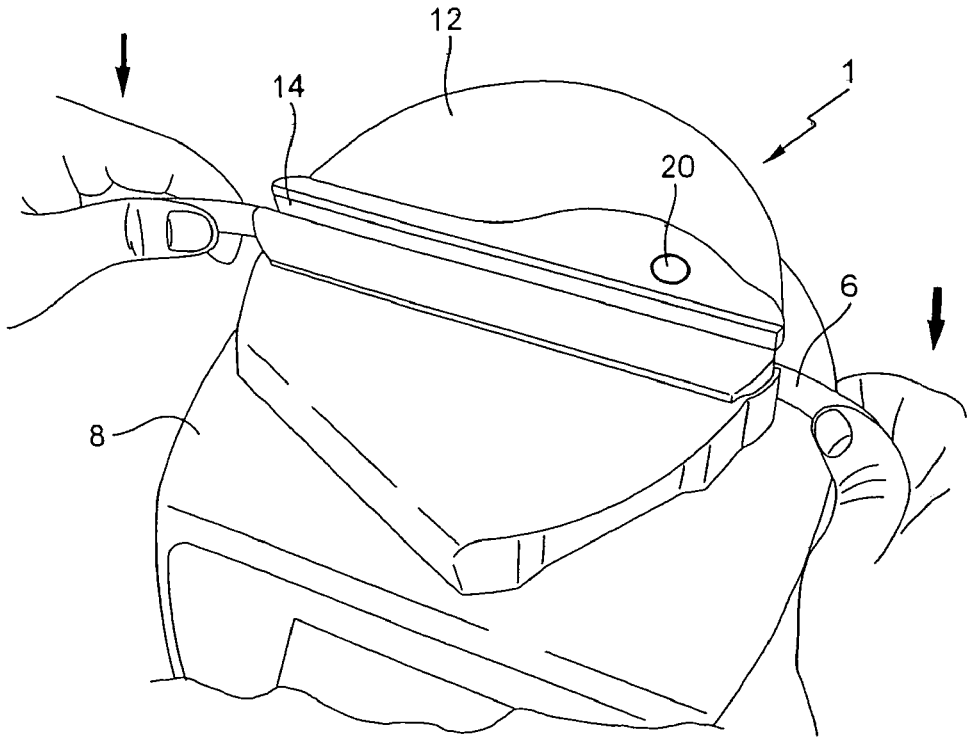
FIG. 9 is a perspective view showing manual fitting of the tube into the pump shown in FIGS. 1 to 6.

When the pump 1 is started, the mobile jaw 15 is in the position shown in FIG. 15, which corresponds to the position of the cap 12 shown in FIGS. 9 and 10, and the rotor 26 is also in the position shown in FIG. 15, with the flat 32 disposed so that a rectilinear passage is formed between the rotor 26 and the jaw 15. The locating members of the cap 12 are then aligned with this rectilinear passage.

First of all, a tube 6 is fitted to the pump 1. To this end, as shown in FIG. 9, the user holds the tube 6 in both hands and inserts it into the groove 14. Because of the bosses 37, this pressing in maneuver has to overcome a hard point, as previously explained, for the tube 6 to reach the appropriate position in the locating members formed at each end of the groove 14, as shown in FIG. 7.

Referring to FIG. 10, the user may then slide the tube 6 laterally, in either direction, to adapt the length of tube available on either side of the cover 12 as a function of the accessories to which the tube 6 is connected (see FIG. 1).

Once this operation has been effected, intervention of the user insofar as the positioning of the tube 6 in the pump 1 is concerned is no longer necessary.

Using the control keys 10, the user indicates that he wishes to start the pump 1, which drives rotation of the plate 27 via its drive system until the mobile jaw 15 reaches the position shown in FIG. 16, in which the tooth 18 of the jaw 15 clamps the web 7 of the tube 6 against the immobilizing pin 25.

When this position is reached, the motor stalls and draws a higher current. When this consumption peak is detected, the motor is stopped.

As the jaw 15 closes, the tube 6 is wrapped around the rotor 26 and at the same time slides as required in the locating members of the cap 12.

The tube 6 is finally held on either side of the rotor 26 by the cooperation of the tooth 18 and the immobilizing pin 25, on the one hand, and by the cooperation of the bearing member 19 and the counter-member 24, on the other hand, which lightly grip both passages of the tube 6.

The mobile jaw 15 is held in this closure position because of the irreversible nature of the system comprising the wheel 39 and the worm 40. The pitch and the helix angle of these components are chosen, in a manner that is well known in the art of mechanical engineering, so that rotation of the worm 40 drives the wheel 39 but rotation of the wheel 39 is not able to drive rotation of the worm 40.

When the tube 6 has been inserted in this way, the rotor 26 may be rotated to start circulating the fluid contained in the tube 6 thanks to the movement of the rollers 30.

When the pump 1 is operating, the safety of the user is ensured by the fact that the mobile jaw 15 is in the FIG. 16 position, that is to say in a position in which removal of the combination of the mobile jaw and the protective cap is prevented by the eccentric finger 28 and the shoulder 22' in the oblong hole 22 in the mobile jaw 15. It is also impossible to remove the cap 12 when the mobile jaw 15 is in the FIG. 15 position, that is to say when the rotor 26 is not moving but the pump 1 is powered up.

On the other hand, when the pump 1 is powered down, the eccentric finger 28 resumes the position shown in FIG. 14, which releases the combination of the mobile jaw and the protective cap, for example to allow cleaning of the components of the pump head 11.

Variants of the device may be envisaged that do not depart from the scope of the invention. In particular, the tube 6 may comprise a single passage or, conversely, a plurality of passages in addition to the second one.

Similarly, although the tube locating members here take the form of a portion of the cap 12, the locating members may be independent of any such cap, in the same way they may be independent of the mobile jaw 15; for example they may be connected directly to the pump head 11. Furthermore, the locating members may comprise any type of clamping or retaining member allowing sliding along the longitudinal axis along which the tube extends and providing for immobilization of the tube in the transverse direction.

The invention claimed is:

1. A peristaltic pump comprising a rotor incorporating rollers, a mobile jaw having an open position, in which it is moved away from the rotor so that a tube on which said pump must act may be placed between the mobile jaw and the rotor, and a closed position, in which the mobile jaw is moved toward the rotor so that said tube is engaged between a curved bearing surface of the mobile jaw and at least one roller of the rotor, the pump further comprising a protective cap mounted to the pump and adapted to cover the mobile jaw and the rotor incorporating the rollers, in the open and closed position of the mobile jaw, the cap having a groove formed through the cap adapted to receive the tube when it is pressed in from outside the cap, the groove having a locating member arranged on each side of the rotor, each locating member being formed of a depression delimited by a bottom and two facing lateral walls, each of the lateral walls having a retaining boss, the boss retaining the tube in the groove and allowing the tube to slide in the longitudinal direction in which the tube extends, and the tube in the groove being disposed in a line between the rotor and the mobile jaw in the open position.

2. The peristaltic pump according to claim 1 wherein the protective cap is rigidly connected to the mobile jaw.

3. The peristaltic pump according to claim 1 wherein the the groove is a rectilinear groove joining the locating members.

4. The peristaltic pump according to claim 1 wherein the rotor includes a flat and the pump further comprises a means for positioning the flat along the line between the rotor and the mobile jaw when in the open position.

5. The peristaltic pump according to claim 1, further comprising a drive shaft adapted to drive the mobile jaw from its open to its closed position and from its closed to its open position and said drive shaft is connected by an irreversible gear to a cam cooperating with the mobile jaw.

6. The peristaltic pump according to claim 1 further comprising a drive shaft adapted to drive the mobile jaw from its open to its closed position and from its closed to its open position and said drive shaft is adapted to place the mobile jaw in a position in which it is free to be separated from the pump when in the open position.

7. The peristaltic pump according to claim 1 further comprising a means for clamping a web of the tube with a plurality of passages connected by the web.

8. The peristaltic pump of claim 1 further comprising the mobile jaw has a round hole formed through the thickness of the mobile jaw, the round hole being coupled to an oblong hole formed through the thickness of the mobile jaw and the oblong hole has a shoulder formed in the thickness of the mobile jaw, the pump having an eccentric finger mounted adjacent the rotor and in line with the round hole of the mobile jaw when in the open position so as to allow for removal of the protective cap and the eccentric finger being retained by the shoulder of the oblong hole when the pump is in the closed position so as to prevent removal of the protective cap.

9. The peristaltic pump of claim 1 further comprising the mobile jaw has a round hole formed through the thickness of the mobile jaw, the round hole being coupled to an oblong hole formed through the thickness of the mobile jaw and the oblong hole has a shoulder formed substantially halfway through the thickness of the mobile jaw, the pump having an eccentric finger mounted adjacent the rotor and in line with the round hole of the mobile jaw when in the open position so as to allow for removal of the protective cap and the eccentric finger being retained by the shoulder of the oblong hole when the pump is in the closed position so as to prevent removal of the protective cap.

* * * * *